US006958208B2

(12) United States Patent
Haye et al.

(10) Patent No.: US 6,958,208 B2
(45) Date of Patent: Oct. 25, 2005

(54) METHODS OF PROVIDING COLOR PHOTOGRAPHIC IMAGE USING ACIDIC STOP AND RINSE SOLUTIONS

(75) Inventors: Shirleyanne E. Haye, Rochester, NY (US); Janet M. Huston, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 46 days.

(21) Appl. No.: 10/696,819

(22) Filed: Oct. 30, 2003

(65) Prior Publication Data

US 2005/0094996 A1 May 5, 2005

(51) Int. Cl.[7] ..... G03C 7/42
(52) U.S. Cl. ..... 430/427; 430/393; 430/430
(58) Field of Search ..... 430/427, 393, 430/430

(56) References Cited

U.S. PATENT DOCUMENTS

| | | | | |
|---|---|---|---|---|
| 4,312,940 A | * | 1/1982 | Nakamura et al. | 430/510 |
| 5,582,963 A | * | 12/1996 | Tsukada | 430/527 |
| 5,645,980 A | | 7/1997 | McGuckin et al. | 430/372 |
| 5,691,118 A | | 11/1997 | Haye | 430/357 |
| 6,365,332 B1 | * | 4/2002 | Price et al. | 430/461 |
| 6,520,694 B1 | | 2/2003 | Hall et al. | 396/567 |

FOREIGN PATENT DOCUMENTS

| | | |
|---|---|---|
| DE | 29 38 803 A | 4/1980 |
| DE | 198 25 181 A | 12/1999 |
| EP | 1 193 549 A | 4/2002 |
| JP | 04 062545 A | 2/1992 |

OTHER PUBLICATIONS

U.S. Appl. No. 10/376,717, (D-85230) filed Feb. 28, 2003, titled "Photographic Peracid Bleaching Composition, Processing Kit, and Method of Use" by Shirleyanne Haye et al. Now USP 6,703,192.

* cited by examiner

*Primary Examiner*—Hoa Van Le
(74) *Attorney, Agent, or Firm*—J. Lanny Tucker

(57) ABSTRACT

Photographic processing of color photographic materials can be carried out using polyphosphonic acids or salts thereof in acidic "stop" solutions or wash solutions after color development. When used in acidic stop solutions, the polyphosphonic acid is preferably carried over into the bleaching solution to provide added stability of the bleaching agent. The acidic stop solutions can also include organic thiols that are used as bleaching accelerators when carried over into the bleaching solutions.

16 Claims, No Drawings

METHODS OF PROVIDING COLOR PHOTOGRAPHIC IMAGE USING ACIDIC STOP AND RINSE SOLUTIONS

FIELD OF THE INVENTION

The present invention relates to photographic processing methods for providing color images in color photographic materials, such as color photographic papers and color negative photographic films. It also relates to acidic "stop" solutions and wash solutions useful in the practice of this method. This invention is useful in the field of photography.

BACKGROUND OF THE INVENTION

The basic processes for obtaining useful color images from exposed color photographic silver halide materials include several steps of photochemical processing such as color development, desilvering (that usually including silver bleaching and silver halide fixing in separate or a single step), and water washing or dye image stabilizing using appropriate photochemical compositions.

Photographic color developing compositions are used to process color photographic materials such as color photographic films and papers to provide the desired dye images early in the photoprocessing method. Such compositions generally contain color developing agents, for example 4-amino-3-methyl-N-(2-methane sulfonamidoethyl)aniline, as reducing agents to react with suitable color forming couplers to form the desired dyes. U.S. Pat. No. 4,892,804 (Vincent et al.) describes conventional color developing compositions that have found considerable commercial success in the photographic industry. Other known color developing compositions are described in U.S. Pat. No. 4,876,174 (Ishikawa et al.), U.S. Pat. No. 5,354,646 (Kobayashi et al.), and U.S. Pat. No. 5,660,974 (Marrese et al.).

The most common bleaching agents for color photographic processing are complexes of ferric [Fe (III)] ion and various organic chelating ligands (such as aminopolycarboxylic acids), of which there are hundreds of possibilities, all with varying photographic bleaching abilities and biodegradability.

Less common bleaching agents are what are known as peracids including the most common peracid, hydrogen peroxide. These bleaching agents provide some advantages over the more common ferric ion-ligand complexes including reduced environmental concerns. Numerous publications describe peroxide, persulfate, and other peracid bleaching agents and their use in photographic processing. See for example U.S. Pat. No. 5,451,491 (Szajewski et al.), U.S. Pat. No. 5,460,924 (Buchanan et al.), U.S. Pat. No. 5,464,728 (Szajewski et al.), U.S. Pat. No. 5,508,151 (O'Toole et al.), U.S. Pat. No. 5,510,232 (O'Toole), U.S. Pat. No. 5,521,056 (Buchanan et al.), U.S. Pat. No. 5,538,834 (Buchanan et al.), U.S. Pat. No. 5,541,041 (Haye), U.S. Pat. No. 5,547,816 (Fyson et al.), U.S. Pat. No. 5,550,009 (Haye et al.), U.S. Pat. No. 5,554,491 (O'Toole et al.), U.S. Pat. No. 5,578,428 (Fyson), U.S. Pat. No. 5,614,355 (Haye et al.), U.S. Pat. No. 5,641,615 (Haye et al.), U.S. Pat. No. 5,641,616 (Haye et al), U.S. Pat. No. 5,656,416 (O'Toole et al.), U.S. Pat. No. 5,683,858 (Fyson), U.S. Pat. No. 5,691,118 (Haye), U.S. Pat. No. 5,691,112 (O'Toole), U.S. Pat. No. 5,763,147 (Haye et al.), and U.S. Pat. No. 5,773,202 (Haye et al.).

Throughout the photographic industry, there is a desire to provide photographic processing solutions that are safe and easy to use, photographically effective, and environmentally acceptable. One desirable property is that the solutions are not objectionable due to unpleasant odors. In addition, there is a need to stabilize some of the peracid bleaching agents that can decompose upon long-term storage or use and providing rapid bleaching.

Despite the many useful photographic bleaching solutions and processing methods known in the art, there is a continuing need for highly effective photographic bleaching processes that include the use or either peracid bleaching or ferric ion bleaching.

U.S. Pat. No. 5,691,118 (noted above) describes the use of multiple acidic "stop" solutions before and after peroxide bleaching in order to reduce yellow stain in photographic color papers.

More recently, copending and commonly assigned U.S. Ser. No. 10/376,717 (filed Feb. 28, 2003 by Haye and Huston) describes peracid bleaching compositions having increased stability in the presence of a cyclicaminomethanediphosphonic acid or a salt thereof.

While the noted technology provides improvements in the art of photographic processing, there is a continuing need to find ways to stabilize both ferric ion and peracid bleaching compositions without having to incorporate the stabilizing compounds directly within the bleaching compositions.

SUMMARY OF THE INVENTION

This invention addresses the problems noted above with a method for providing a color photographic image comprising:

A) color developing an imagewise exposed color photographic material using a color developing composition comprising at least 0.0005 mol/l of a color developing agent, B) stopping color development by contacting the color photographic material with an acidic stop solution having a pH less than or equal to 5, and C) desilvering the color photographic material with a composition having photographic bleaching capability, provided that the acidic stop solution comprises at least 0.001 mol/l of a polyphosphonic acid or a salt thereof, and a portion of the acidic stop solution is carried over into the bleaching composition at a rate so that the amount of polyphosphonic acid (or salt thereof) carried over into the bleaching composition is from about 0.000005 to about 0.001 mol per $m^2$ of processed color photographic material.

Preferred embodiments of the present invention include a method for providing a color photographic image comprising:

A) color developing an imagewise exposed color negative photographic film or color photographic paper using a color developing composition comprising at least 0.0005 mol/l of a color developing agent and at least 0.0005 mol/l of an organic antioxidant, B) stopping color development by contacting the color photographic material with an acidic stop solution having a pH of from about 1 to about 5, and comprising from about 0.001 to about 1 mol/l of morpholinomethanediphosphonic acid (or a salt thereof) and from about 0.0005 to about 0.5 mol/l of L-cysteine or 2-dimethylaminoethanethiol-HCl, C) bleaching the color negative photographic film or color photographic paper with a peroxide or persulfate photographic bleaching composition, and subsequently or simultaneously, D) fixing the bleached color negative photographic film or color photographic paper, wherein the acidic stop solution is carried over into the bleaching composition at a rate such that morpholinomethanediphosphonic acid (or salt thereof) is carried over into the bleaching composition in an amount of from about 0.000005 to about 0.001 mol per $m^2$ of processed color negative photographic film or color photographic paper.

Preferred acidic stop solutions of the present invention have a pH of less than or equal to 5 and consist essentially of at least 0.001 mol/l of a polyphosphonic acid (or a salt thereof), and at least 0.0005 mol/l of a heterocyclic, aliphatic, or aromatic thiol.

In other embodiments of the present invention, a method for providing a color photographic image comprises:

A) color developing an imagewise exposed color photographic material using a color developing composition comprising at least 0.0005 mol/l of a color developing agent, B) desilvering the color photographic material, and C) at any time after step A, washing the color photographic material with a wash solution having a pH greater than 5 and consisting essentially of a polyphosphonic acid or a salt thereof and an anionic or nonionic surfactant.

The methods of the present invention provide advantages with the use of particular acidic stop and/or wash solutions that include polyphosphonic acids (or salts thereof). The acidic stop solution is used immediately after color development to stop the activity of the color developing agents that may have been carried over with the processed photographic material into the stop solution. Advantageously, the acidic stop solution can also include an organic thiol that, when carried over into the following bleaching or bleach/fixing solutions, can act as bleaching activators. In addition, as the acidic stop solution is carried over into those solutions, the polyphosphonic acid present in the acidic stop solution provides stability for those solutions without having to be incorporated directly therein.

The present invention also provides useful wash solutions that can be used as any stage of the photographic processing. Preferably, they are used after all of the desilvering steps. The wash solution contains a polyphosphonic acid (or salt thereof) to avoid the formation of unwanted precipitates.

DETAILED DESCRIPTION OF THE INVENTION

The color developing composition used in this invention can be formulated as an aqueous concentrate, such as a single-part concentrate, that can then be diluted at least two times with water or buffer (preferably at least four times) to form a working strength color developing composition. Alternatively, a working strength composition can be prepared by mixing all of the desired components in any desired order at working strength concentrations. Alternatively, one or more concentrated parts can be supplied to a processing vessel as a replenishing solution.

The color developing compositions contain one or more color developing agents that may be in the form of a sulfate salt or in free base form. Other useful components of such compositions include one or more antioxidants for the color developing agent, and one or more calcium or other metal ion sequestering agents. Optional and preferred addenda are also described below.

More specifically, the color developing compositions include one or more color developing agents that are well known in the art that, in oxidized form, will react with dye forming color couplers in the processed materials. Such color developing agents include, but are not limited to, aminophenols, p-phenylenediamines (especially N,N-dialkyl-p-phenylenediamines) and others which are well known in the art, such as EP 0 434 097A1 (published June 26, 1991) and EP 0 530 921A1 (published Mar. 10, 1993). It may be useful for the color developing agents to have one or more water-solubilizing groups as are known in the art. Further details of such materials are provided in *Research Disclosure*, publication 38957, pages 592–639 (September 1996).

Preferred color developing agents include, but are not limited to, N,N-diethyl p-phenylenediamine sulfate (KODAK Color Developing Agent CD-2), 4-amino-3-methyl-N-(2-methane sulfonamidoethyl)aniline sulfate, 4-(Nethyl-N-β-hydroxyethylamino)-2-methylaniline sulfate (KODAK Color Developing Agent CD-4), p-hydroxyethylethylaminoaniline sulfate, 4-(N-ethyl-N-2-methanesulfonylaminoethyl)-2-methylphenylenediamine sesquisulfate (KODAK Color Developing Agent CD-3), 4-(N-ethyl-N-2-methanesulfonylaminoethyl)-2-methylphenylenediamine sesquisulfate, and others readily apparent to one skilled in the art. Kodak Color Developing Agent CD-3 is preferred in the processing of photographic color papers and Kodak Color Developing Agent CD-4 is preferred in the processing of color negative films. These compounds are readily available from commercial sources.

In embodiments of single-part concentrated compositions, the color developing agents are used in "free base form" as described in U.S. Pat. No. 6,077,651 (noted above), incorporated herein by reference.

In order to protect the color developing agents from oxidation, one or more antioxidants are generally included in the color developing compositions. Either inorganic or organic antioxidants can be used. Many classes of useful antioxidants are known, including but not limited to, sulfites (such as sodium sulfite, potassium sulfite, sodium bisulfite and potassium metabisulfite), hydroxylamine (and derivatives thereof), hydrazines, hydrazides, amino acids, ascorbic acid (and derivatives thereof), hydroxamic acids, aminoketones, mono- and polysaccharides, mono- and polyamines, quaternary ammonium salts, nitroxy radicals, alcohols, 1,4-cyclohexanediones, and oximes. Mixtures of compounds from the same or different classes of antioxidants can also be used if desired.

Especially useful antioxidants are hydroxylamine or salts and hydroxylamine derivatives as described for example, in U.S. Pat. No. 4,892,804 (noted above), U.S. Pat. No. 4,876,174 (noted above), U.S. Pat. No. 5,354,646 (noted above), U.S. Pat. No. 5,660,974 (noted above), and U.S. Pat. No. 5,646,327 (Bums et al.), the disclosures of which are all incorporated herein by reference with respect to antioxidants. Many of these antioxidants are monoalkyl- and dialkylhydroxylamines having one or more substituents on one or both alkyl groups. Particularly useful alkyl substituents include sulfo, carboxy, amino, sulfonamido, carbonamido, hydroxy and other solubilizing substituents. More preferably, the hydroxylamine derivatives comprise one or more sulfo, carboxy, or hydroxy solubilizing groups.

Some preferred hydroxylamine derivative antioxidants include N,N-diethylhydroxylamine, N-isopropyl-N-ethylsulfonatohydroxylamine, and N,N-diethylsulfonatohydroxylamine.

The noted hydroxylamine derivatives can be monoalkyl- or dialkylhydroxylamines having one or more hydroxy substituents on the one or more alkyl groups. Representative compounds of this type are described for example in U.S.

Pat. No. 5,709,982 (Marrese et al.), incorporated herein by reference, and include N,N-bis(2,3-dihydroxypropyl)hydroxylamine, N,N-bis(2-methyl-2,3-dihydroxypropyl)hydroxylamine and N,N-bis(1-hydroxymethyl-2-hydroxy-3-phenylpropyl)hydroxylamine.

Many of the noted antioxidants (organic or inorganic) are either commercially available or prepared using starting materials and procedures described in the references noted above in describing hydroxylamines.

Buffering agents are generally present in the color developing compositions to provide or maintain desired alkaline pH of from about 7 to about 13, and preferably from about 8 to about 12. These buffering agents are preferably soluble in the organic solvent described below and have a pKa of from about 9 to about 13. Such useful buffering agents include, but are not limited to carbonates, borates, tetraborates, glycine salts, triethanolamine, diethanolamine, phosphates and hydroxybenzoates. Alkali metal carbonates (such as sodium carbonate, sodium bicarbonate and potassium carbonate) are preferred buffering agents. Mixtures of buffering agents can be used if desired.

In addition to buffering agents, pH can also be raised or lowered to a desired value using one or more acids or bases. It may be particularly desirable to raise the pH by adding a base, such as a hydroxide (for example sodium hydroxide or potassium hydroxide), in the various "parts" or solutions of the color developing kits.

It is also possible to include calcium and other metal ion sequestering agents (for example, for iron, copper, and/or manganese ion sequestration) in the color developing composition as long as the other conditions of the invention are met. Particularly useful calcium ion sequestering agents include the various polyphosphonic acids (and salts thereof) described below in relation to the acidic stop and wash solutions of this invention.

The color developing compositions can also include one or more of a variety of other addenda that are commonly used in photographic color developing compositions, including alkali metal halides (such as potassium chloride, potassium bromide, sodium bromide and sodium iodide), auxiliary co-developing agents (such as phenidone type compounds particularly for black and white developing compositions), antifoggants, development accelerators, optical brighteners (such as triazinylstilbene compounds), wetting agents, fragrances, stain reducing agents, surfactants, defoaming agents, and water-soluble or water-dispersible color couplers, as would be readily understood by one skilled in the art [see for example, *Research Disclosure* publications noted above]. The amounts of such additives are well known in the art also. Representative color developing compositions are described below in the examples.

The following TABLES I and II list the general and preferred amounts of some components of the color developing compositions (concentrates and working strength compositions, respectively). The preferred ranges are listed in parentheses ( ), and all of the ranges are considered to be approximate or "about" in the upper and lower end points. During color development, the actual concentrations can vary depending upon extracted chemicals in the composition, replenishment rates, water losses due to evaporation and carryover from any preceding processing bath and carryover to the next processing bath. The amounts are total concentrations for the various components that can be present in mixtures.

TABLE I (CONCENTRATES)

| COMPONENT | CONCENTRATIONS |
|---|---|
| Color developing agent(s) | 0.005–1 mol/l<br>(0.05–0.8 mol/l) |
| Antioxidant(s) | 0.005–1 mol/l<br>(0.05–1 mol/l) |
| Buffering agent(s) | 0.5–3 mol/l<br>(1.5–2.5 mol/l) |
| Calcium Ion Sequestering Agent(s) | 1–50 g/l<br>(2–40 g/l) |

TABLE II (WORKING STRENGTH)

| COMPONENT | CONCENTRATIONS |
|---|---|
| Color developing agent(s) | 0.0005–0.25 mol/l<br>(0.005–0.03 mol/l) |
| Antioxidant(s) | 0.0005–0.25 mol/l<br>(0.005–0.05 mol/l) |
| Buffering agent(s) | 0.002–0.8 mol/l<br>(0.01–0.5 mol/l) |
| Calcium Ion Sequestering Agent(s) | 1–25 g/l<br>(1–20 g/l) |

The acidic stop solutions useful in the present invention generally have a pH less than or equal to 5 and preferably from about 1 to about 4.8. Various acids can be included in the solution to provide the desired pH including but not limited to sulfuric acid, acetic acid, glycolic acid, maleic acid, propionic acid, nitric acid, methanesulfonic acid, citric acid, succinic acid, 2-chloropropionic acid, 3-chloropropionic acid, and other inorganic or organic acids that have a pKa less than about 4. A preferred acid is sulfuric acid, methanesulfonic acid, or acetic acid. The amount of acid can vary depending upon the pH desired and the strength of a given acid, and it would be readily ascertainable by a skilled worker in the art. The acidic stop solution can also include one or more biocides if desired.

It is essential however, that the acidic stop solution comprises one or more polyphosphonic acids (or salts thereof). Polyphosphonic acids are well known in the art, and are described for example in U.S. Pat. No. 4,596,765 (noted above) and *Research Disclosure* publications Item 13410 (June, 1975), 18837 (December, 1979), and 20405 (April, 1981). Alkali metal and ammonium salts of all of the polyphosphonic acids are contemplated as useful in the present invention.

Useful polyphosphonic acids are readily available from a number of commercial sources. Particularly useful polyphosphonic acids are the diphosphonic acids (and salts thereof), polyaminopolyphosphonic acids (and salts thereof), and cyclicaminodiphosphonic acids (and salts thereof) described below. It is possible to use one or more compounds of one or more of these classes in combination. Useful diphosphonic acids include hydroxyalkylidene diphosphonic acids, aminodiphosphonic acids, amino-N,N-dimethylenephosphonic acids, and N-acyl aminodiphosphonic acids.

Other useful polyphosphonic acids (and salts thereof) are compounds that have at least five phosphonic acid (or salt) groups. A mixture of such compounds can be used if desired.

Representative compounds of this nature can be represented by the following Structure I:

(I)

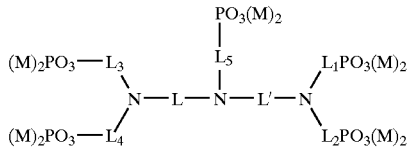

wherein L, L', $L_1$, $L_2$, $L_3$, $L_4$ and $L_5$ are independently substituted or unsubstituted divalent aliphatic linking groups, each independently having 1 to 4 carbon, oxygen, sulfur or nitrogen atoms in the linking group chain. Preferably, these substituted or unsubstituted divalent linking groups have 1 to 4 carbon atoms in the linking group chain (such as substituted or unsubstituted branched or linear alkylene groups). More preferably, the divalent linking groups are independently substituted or unsubstituted methylene or ethylene. Most preferably, L and L' are each substituted or unsubstituted ethylene (preferably unsubstituted), and each of the other linking groups is an unsubstituted methylene group. M is hydrogen or a monovalent cation (such as ammonium ion or an alkali metal salt).

The noted divalent groups can be substituted with any substituent that does not interfere with the desired performance of the sequestering agent, or with the photochemical properties of the color developing compositions. Such substituents include, but are not limited to, hydroxy, sulfo, carboxy, halo, lower alkoxy (1 to 3 carbon atoms) or amino.

A particularly useful polyphosphonic acid of this type is diethylene-triaminepentamethylenephosphonic acid or an alkali metal salt thereof (available as DEQUEST™ 2066 from Solutia Co.).

Preferred hydroxyalkylidene diphosphonic acids (or salts thereof) can be represented by the following Structure II:

(II)

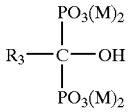

wherein $R_3$ is a substituted or unsubstituted alkyl group having 1 to 5 carbon atoms (methyl, methoxymethyl, ethyl, isopropyl, n-butyl, t-butyl and n-pentyl) and M is hydrogen or a monovalent cation (such as ammonium or alkali metal ions). Preferably, $R_3$ is methyl or ethyl, and most preferably, it is ethyl.

Representative polyphosphonic acids of this class include, but are not limited to, 1-hydroxyethylidene-1,1-diphosphonic acid, 1-hydroxy-n-propylidene-1,1-diphosphonic acid, 1-hydroxy-2,2-dimethylpropylidene-1,1, diphosphonic acid and others that would be readily apparent to one skilled in the art (and alkali metal and ammonium salts thereof). The first compound is most preferred and is available as DEQUEST™ 2010, and its tetrasodium salt is available as DEQUEST™ 2016D, both from Solutia Co.

A preferred polyphosphonic acid is chosen from cyclicaminodiphosphonic acids (and salts thereof) such as those described in U.S. Pat. No. 4,873,180 (Marchesano et al.) wherein the "cyclicamino" groups comprise a substituted or unsubstituted 3- to 6-membered ring that is attached to a methyl group that includes two phosphonic acids (or salts thereof). Such rings include but not limited to substituted or unsubstituted aziridino, pyrrolidino, imidazolidino, piperidino, piperazino, isoindolino, and morpholino groups. The substituted or unsubstituted morpholino groups are preferred. Suitable substituents for the cyclicamino groups include, but are not limited to, alkyl groups having 1 to 4 carbon atoms, halo groups, nitro groups, cyano groups, aryl groups, alkoxy groups having 1 to 4 carbon atoms, aryloxy groups, sulfamoyl groups, acyloxy groups, acylamino groups, ureido groups, sulfonamido groups, hydroxy groups, and others that would be readily apparent to one skilled in the art from the teaching of U.S. Pat. No. 4,873,180, incorporated herein by reference.

The "cyclicamino" groups are attached to a methyl group that includes two phosphonic acids (or alkali metal or ammonium salts thereof) and the remaining valence of the methyl group can be hydrogen, a substituted or unsubstituted alkyl group, or a substituted or unsubstituted aryl group.

Representative cyclicaminomethanediphosphonic acids (or salts thereof) are compounds 7–17 of U.S. Pat. No. 4,873,180 (noted above). A most preferred compound of this type is morpholinomethanediphosphonic acid or a salt thereof that is commercially available as BUDEX™ 5103 from Budenheim (Germany).

The polyphosphonic acid (or salt thereof) is present in the acidic stop solution in an amount of at least 0.001 mol/l and preferably at from about 0.001 to about 1 mol/l. The amount of polyphosphonic acid can be adjusted to meet the purposes of the invention as well as to "buffer" the acidic stop solution at the desired pH.

Preferred acidic stop solutions of the present invention include one or more organic thiols, and particularly heterocyclic, aliphatic, or aromatic thiols. Heterocyclic thiols include but are not limited to aminothiadiazolethiol, mercaptotriazole, imidazolethiol, and aminomercaptotriazole.

In addition, useful thiols include monothioglycerol and compounds that can be represented by any of the following Structure III, IV, or V:

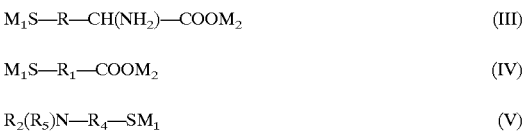

$$M_1S—R—CH(NH_2)—COOM_2 \quad (III)$$

$$M_1S—R_1—COOM_2 \quad (IV)$$

$$R_2(R_5)N—R_4—SM_1 \quad (V)$$

wherein R is a divalent aliphatic linking group having at least 1 carbon atom in the chain. Representative divalent aliphatic linking groups include but are not limited to, substituted or unsubstituted alkylene groups (linear or branched) having 2 to 10 carbon atoms, a substituted or unsubstituted phenylene group, or a substituted or unsubstituted cyclohexylene group. Preferably, R is substituted or unsubstituted alkylene having 1 to 4 carbon atoms, and more preferably R is methylene or ethylene.

$R_1$ is substituted or unsubstituted phenylene, or an unsubstituted alkylene group having 1 or 2 carbon atoms. Where $R_1$ is phenylene, the mercapto and carboxy groups are preferably in the 1,3- or 1,4-positions. More preferably $R_1$ is an unsubstituted alkylene having 2 carbon atoms.

$R_2$ and $R_5$ are independently hydrogen, a substituted or unsubstituted lower alkyl having 1 to 4 carbon atoms (such as methyl, ethyl, n-propyl, iso-propyl, and t-butyl), or a substituted or unsubstituted phenyl group.

$R_4$ is a substituted or unsubstituted alkylene group (linear or branched) having 1 to 4 carbon atoms, a substituted or unsubstituted cyclohexylene group, or a substituted or unsubstituted phenylene group. Preferably, $R_4$ is a substituted or unsubstituted alkylene group having 1 to 3 carbon atoms, and more preferably it is ethylene.

$M_1$ and $M_2$ are independently hydrogen, an alkali metal or ammonium ion, or methyl group and preferably $M_1$ is hydrogen and $M_2$ is either hydrogen or an alkali metal ion.

The monovalent and divalent aliphatic groups in the Structures III, IV, and V can include carbon atom chains that are interrupted with one or more divalent groups containing nitrogen, sulfur or oxygen atoms.

Representative thiols of Structure III include cysteine (D- or L-, or D,L-) and the hydrochloride salt thereof, homocysteine, methionine, 3mercaptovaline and carboxylate salts thereof. L-cysteine and L-cysteine hydrochloride are preferred in this group of compounds. Mixtures of stereoisomers (where possible) can also be used.

Representative thiols of Structure IV include 2mercaptopropanoic acid, 3-mercaptopropanoic acid, 3-mercapto-1-benzoic acid, mercaptoacetic acid, and carboxylate salts thereof.

Representative thiols of Structure V include 2-aminoethanethiol, 2-aminoethanethiol hydrochloride, 2-dimethylaminoethanethiol (and the hydrochloride salt thereof), N-methyl-N-ethylaminoethanethiol, diethylaminoethanetiol, and 3-aminopropanethiol hydrochloride.

Thus, the preferred group of thiols useful in this invention includes one or more isomers of cysteine or a hydrochloride salt thereof, homocysteine, methionine, 3-mercaptovaline, 2-mercaptopropionic acid, 3mercaptopropionic acid, 3-mercapto-1-benzoic acid, mercaptoacetic acid, 2-aminoethanethiol, 2-aminoethanethiol hydrochloride, 3-aminopropanethiol hydrochloride, or any appropriate carboxylate salts thereof. Of these, one or more isomers of cysteine or a salt thereof are most preferred. Mixtures of these thiols of any of Structures III to V can be used if desired.

The thiols can be present in the acidic stop solution in an amount of at least 0.0005 mol/l and preferably at from about 0.0005 to about 0.5 mol/l. Many of the thiols are readily available from a number of commercial sources including Aldrich Chemical Company.

The color developing compositions described herein have utility to provide color development in an imagewise exposed color photographic silver halide element comprising a support and one or more silver halide emulsion layers containing an imagewise distribution of developable silver halide emulsion grains. A wide variety of types of photographic elements (both color negative and color reversal films and papers, and color motion picture films and prints) containing various types of emulsions can be processed using the present invention, the types of elements being well known in the art (see *Research Disclosure* publication 38957 noted above). In particular, the invention can be used to process color photographic papers of all types of emulsions including so-called "high chloride" and "low chloride" type emulsions, and so-called tabular grain emulsions as well. The color developing composition can also be used in processing of color reversal and color negative films.

The photographic elements processed in the practice can be single or multilayer color elements. Multilayer color elements typically contain dye image-forming units sensitive to each of the three primary regions of the visible spectrum. Each unit can be comprised of a single emulsion layer or multiple emulsion layers sensitive to a given region of the spectrum. The layers of the element can be arranged in any of the various orders known in the art. In an alternative format, the emulsions sensitive to each of the three primary regions of the spectrum can be disposed as a single segmented layer. The elements can also contain other conventional layers such as filter layers, interlayers, subbing layers, overcoats and other layers readily apparent to one skilled in the art. A magnetic backing can be included on the backside of conventional supports.

More details of the element structure and components, and suitable methods of processing various types of elements are described in *Research Disclosure* publication 38957 noted above. Included within such teachings in the art is the use of various classes of cyan, yellow and magenta color couplers that can be used with the present invention (including pyrazolone and pyrazolotriazole type magenta dye forming couplers). In addition, the present invention can be used to process color photographic papers having pigmented resin-coated paper supports which are prepared with the usual internal and external sizing agents (including alkylketene dimers and higher fatty acids), strengthening agents and other known paper additives and coatings.

Color development of an imagewise exposed photographic silver halide element is carried out by contacting the element with a color developing composition under suitable time and temperature conditions, in suitable processing equipment, to produce the desired developed color image.

After color development, the color photographic material is contacted with the acidic stop solution for generally up to 120 seconds and preferably for from about 15 to about 60 seconds at from about 20 to about 40° C.

Immediately following this step, the processed color photographic material is desilvered in a suitable fashion using one or more separate bleaching and fixing steps, or one or more combined bleach-fixing steps and the various known processing protocols and processing solutions including the conventional Process C-41 processing of color negative films, Process RA-4 for processing color papers and Process E-6 for processing color reversal films (see for example, *Research Disclosure* publication 38957 noted above).

Numerous bleaching agents are known in the art, including hydrogen peroxide and other peracid compounds, persulfates, periodates and ferric ion salts or complexes with polycarboxylic acid chelating ligands. Particularly useful ferric ion chelating ligands include conventional polyaminopolycarboxylic acids including ethylenediaminetetraacetic acid and others described in *Research Disclosure* publication 38957 noted above, U.S. Pat. No. 5,582,958 (Buchanan et al.) and U.S. Pat. No. 5,753,423 (Buongiome et al.). Biodegradable chelating ligands are also desirable because the impact on the environment is reduced. Useful biodegradable chelating ligands include, but are not limited to, iminodiacetic acid or an alkyliminodiacetic acid (such as methyliminodiacetic acid), ethylenediaminedisuccinic acid and similar compounds as described in EP 0 532,003A1 (Ueda et al.), and ethylenediamine monosuccinic acid and similar compounds as described in U.S. Pat. No. 5,691,120 (Wilson et al.). Useful fixing agents are also well known in the art and include various thiosulfates and thiocyanates or mixtures thereof as described for example in U.S. Pat. No. 6,013,424 (Schmittou et al.). These references are incorporated herein by reference.

Photographic bleaching is preferably carried out according to the present invention in one or more steps using one or more peracid photographic bleaching agents as the first essential component of the bleaching composition. Such compounds include, but are not limited to, the hydrogen, alkali and alkaline earth salts of persulfate, peroxide, perchlorate, perborate, periodate, perphosphate, percarbonate, chlorate, bromate, iodate, and metaperiodate. These bleaching agents can be formulated as described, for example, in

*Research Disclosure* September 1994, Item 36544 published by Kenneth Mason Publications, Ltd., Dudley House, 12 North Street, Emsworth, Hampshire PO10 7DQ, England (also available from Emsworth Design, 147 West 24th Street, New York, N.Y. 10011), and the patents listed in the "Background" above, all of which are incorporated herein by reference.

Especially useful peracids are peroxides, persulfates, and periodates. Sodium persulfate and hydrogen peroxide are most preferred bleaching agents. Thus, persulfate and peroxide bleaching compositions are preferred peracid bleaching compositions.

Compounds that generate or provide a suitable peracid can be present in the bleaching compositions. For example, precursors of hydrogen peroxide are well known in the art and include, for example, perborates, perphosphates, percabonates, percarboxylates, and hydrogen peroxide urea. In addition, hydrogen peroxide can be generated within a solution by electrolysis.

The bleaching compositions can include a variety of optional chemical components that provide one or more chemical or physical functions, including but not limited to, buffers, rehalogenating agents, metal ion sequestering agents, bleach accelerating agents, biocides, photographic hardeners, and other materials readily apparent to one skilled in the art.

It is particularly useful to include one or more buffers in the bleaching composition (when in aqueous form) to maintain the pH of up to 13 (preferably from about 1 to about 11).

If the bleaching composition is highly acidic, that is having a pH less than 2 (preferably less than 1.5, and more preferably, less than 1.25), the pH can be provided by adding at least one conventional strong acid, including, but not limited to, sulfuric acid, phosphoric acid and methanesulfonic acid. Sulfuric acid is preferred.

If the pH of the bleaching composition is between 3 and 6, the pH may be maintained with any of a variety of organic or inorganic buffers, as long as the buffer has at least one pKa value between 1.5 and 7.5 (preferably 3 to 6).

If the bleaching composition is alkaline that is having a pH within the general range of from about 7 to about 13 (with a pH of from about 8 to about 12 being preferred, and a pH of from about 9 to about 11 being most preferred), the pH can be provided by adding a conventional weak or strong base, and can be maintained by the presence of one or more suitable buffers including, but not limited to, sodium carbonate, potassium carbonate, sodium borate, potassium borate, sodium phosphate, calcium hydroxide, sodium silicate, α-alaninediacetic acid, arginine, asparagine, ethylenediamine, ethylenediaminetetraacetic acid, ethylenediaminedisuccinic acid, glycine, histidine, imidazole, isoleucine, leucine, methyliminodiacetic acid, nicotine, nitrilotriacetic acid, piperidine, proline, purine and pyrrolidine. Sodium and potassium carbonates are preferred. The amount of useful buffer or base would be readily apparent to one skilled in the art.

It may also be desirable to include a rehalogenating agent in the bleaching composition including but not limited to, chloride and/or bromide ions.

Having the acidic stop solution used before the desilvering steps provides the advantage that the polyphosphonic acid of the acidic stop solution is carried over by the processing photographic material into the next bath, that is usually a bleaching or bleach-fixing solution. The polyphosphonic acid (or salt thereof) is carried over in sufficient quantities to stabilize the bleaching agent, and particularly the peracid bleaching agents. In generally, the amount of polyphosphonic acid (or salt thereof) that is carried over is from about 0.000005 to about 0.001 mol per $m^2$ of processed color photographic material.

Depending upon the polyphosphonic acid concentration, the acidic stop solution carryover is generally from about 30 to about 250 ml/$m^2$ of processed color photographic material.

Processing according to the present invention can be carried out using conventional deep tanks holding processing solutions. Alternatively, it can be carried out using what is known in the art as "low volume thin tank" processing systems, or LVTT, which have either a rack and tank or automatic tray design. These processors are sometimes included in what are known as "minilabs." Such processing methods and equipment are described, for example, in U.S. Pat. No. 5,436,118 (Carli et al.) and publications noted therein. Some minilab processing machines are commercially available as Noritsu 2211 SM Printer/Paper Processor, Noritsu 2102SM Printer/Paper Processor, and Noritsu 2301 SM Printer/Paper Processor.

Rinsing and/or stabilizing steps can be carried out before or after desilvering if desired using various rinsing or stabilizing compositions that may include one or more anionic or nonionic surfactants. Representative compositions and conditions for this purpose are, for example, described in U.S. Pat. No. 5,534,396 (McGuckin et al.), U.S. Pat. No. 5,578,432 (McGuckin et al.), U.S. Pat. No. 5,645,980 (McGuckin et al.), U.S. Pat. No. 5,667,948 (McGuckin et al.), and U.S. Pat. No. 5,716,765 (McGuckin et al.), all incorporated herein by reference. In most processing methods, a "final" rinse or washing step is used after desilvering to remove all processing chemicals as well as debris that may be encountered in the various processing baths.

In preferred embodiments, the wash solution used in the practice of this invention contains one or more nonionic or anionic surfactants (usually at least 0.1 g/l), and one or more polyphosphonic acids (or salts thereof) such as those described above for use in the acidic stop solutions. If both an acidic stop solution and wash solution are used in the processing method, the polyphosphonic acids (or salts thereof) used in those solutions can be the same or different. Preferably, the wash solutions include one or more cyclicaminodiphosphonic acids (or a salt thereof) as described above wherein the cyclicamino group comprises a substituted or unsubstituted 3- to 6-membered ring that is attached to a methyl group that includes two phosphonic acids (or salts thereof). The most preferred cyclicaminomethanediphosphonic acid (or a salt thereof) in the wash solution is morpholinomethanediphosphonic acid (or a salt thereof). In some embodiments, the acidic stop and wash solutions can be the same solution and used at different stages of the processing method.

The processing time and temperature used for each processing step of the present invention are generally those conventionally used in the art. For example, color development is generally carried out at a temperature of from about 20 to about 60° C. The overall color development time can be up to 40 minutes, and preferably from about 25 to about 450 seconds. The shorter overall color development times are desired for processing color photographic papers. Conventional conditions can be used for other processing steps including desilvering and rinsing/stabilizing.

The desilvering step(s) can be carried out using any conventional time or temperature. For example, bleaching steps are generally carried out for from about 10 to about 480 seconds in various processing protocols at a temperature of from about 20 to about 65° C. Fixing steps are generally carried out for from about 10 to about 360 seconds (preferably from about 15 to about 240 seconds) at a temperature of from about 20 to about 65° C. If bleaching and fixing are combined in a bleach-fixing step, it is generally carried out for from about 10 to about 600 seconds (preferably from about 10 to about 400 seconds) at a temperature of from about 20 to about 65° C.

The following examples are provided to illustrate the practice and not to limit it in any way. Unless otherwise indicated, percentages are by weight.

EXAMPLE 1

Color Paper Processing Method

Samples of KODAK Edge® 8 Color Paper were given a step wedge test object exposure at 1/10 second with HA-50, NP-11 filters, and 0.3 Inconel on a conventional 1 B sensitometer. The color paper samples were then processed using the processing protocols and solutions described below.

Comparison method A utilized the EKTACOLOR® RA developer followed by washing and rinsing. Comparison method B utilized the EKTACOLOR® RA Developer and an acidic stop solution A followed by washing and rinsing. Comparison method C utilized the conventional EKTACOLOR® RA-4 Process bleach/fixing solutions and protocol shown in the following TABLES III and VI-A. Comparison method D utilized the conventional separate EKTACOLOR® RA-4 bleaching and fixing solutions and protocol shown in the following TABLES IV and IX. Methods E-G (TABLES V and VIII) utilized the same protocol described in Table IV, but with morpholinomethanediphosphonic acid (MMDP) instead of acetic acid in the acidic stop solution (TABLE VI). Additionally, a peroxide bleaching solution was used in method F and a persulfate bleaching solution was used in method G instead of the conventional EKTACOLOR® RA bleach. After processing, all of the samples were air-dried and their IR densities at 45 sec. bleaching are tabulated in the following TABLE X.

TABLE III

| EKTACOLOR ® RA-4 PROTOCOL: | | |
|---|---|---|
| Color development (EKTACOLOR ® RA) | 45 seconds | 35° C. |
| Bleaching/fixing | 45 seconds | 35° C. |
| Washing | 90 seconds | 33° C. |

TABLE IV

| Processing Protocol: | | |
|---|---|---|
| Color development (EKTACOLOR ® RA) | 45 seconds | 35° C. |
| Stop bath (see below) | 30–60 seconds | 29–35° C. |
| Wash | 30 seconds | 29–35° C. |
| Bleaching | 45–90 seconds | 29–35° C. |
| Wash | 45 seconds | 29–35° C. |
| Fixing (see below) | 45 seconds | 29–35° C. |
| Rinsing (water) | 90 seconds | 29–35° C. |
| Final Rinse | 30 seconds | 29–35° C. |

TABLE V

| Acidic Stop Solution A: | |
|---|---|
| Water | 900 ml |
| Glacial acetic acid | 7 ml |
| Water to make | 1.0 liter |
| pH 4.7 adjusted with KOH or acetic acid | |

TABLE VI

| Acidic Stop Solution B: | |
|---|---|
| Water | 900 ml |
| MMDP | 0.1 mol/l |
| Water to make | 1.0 liter |
| pH ~ 4 adjusted with KOH or $H_2SO_4$ | |

TABLE VI-A

| EKTACOLOR ® RA Bleaching Solution: | |
|---|---|
| Water | 700 ml |
| Acetic acid | 5.63 ml |
| Potassium bromide | 23.93 g |
| 1,3-Diaminopropane-tetraacetic acid (PDTA) | 15.35 g |
| 1,3-Diaminopropane-2-ol-tetraacetic acid | 0.5 g |
| Potassium hydroxide (45% solution) | 21.17 g |
| Ferric nitrate nonahydrate | 18.33 g |
| Water to make | 1 liter |
| pH (adjusted with $K_2CO_3$ or $H_2SO_4$) | 4.75 |

TABLE VII

| Peroxide Bleaching Solution: | |
|---|---|
| Hydrogen peroxide (30%) | 0.98 mol/l |
| Sodium chloride | 0.35 mol/l |
| Sodium carbonate buffer | 0.05 mol/l |
| pH | 10 |

TABLE VIII

| Persulfate bleaching Solution: | |
|---|---|
| Water | 600 ml |
| Sodium hexametaphosphate | 2 g |
| Sodium persulfate | 33 g |
| Sodium chloride | 15 g |
| Sodium dihydrogen phosphate | 7 g |
| Phosphoric acid (85%) | 2.5 ml |
| Gelatin | 0.3 g |
| $H_2SO_4$ to pH | ~1 |
| Final volume | 1 liter |

TABLE IX

| Fixing Solution: | |
|---|---|
| Water | 600 ml |
| Potassium sulfite | 12.0 g |
| Ethylenediaminetetraacetic acid, sodium salt | 0.99 g |
| Sodium thiosulfate pentahydrate | 42.72 g |
| Water to make | 1 liter |
| pH adjusted with acetic acid. | 6.5 |

TABLE X

| Method | Stop Solution | Bleaching Solution | $D_{min}$ | $D_{mid}$ | $D_{max}$ |
|---|---|---|---|---|---|
| | | | IR density @ 1000 nm | | |
| A | | | 1.12 | 1.44 | 1.57 |
| B | A | | 0.82 | 1.38 | 1.57 |
| C | | Bleach/fix | 0.79 | 0.81 | 0.83 |
| D | A | RA | 0.80 | 0.80 | 0.80 |
| E | B | RA | 0.80 | 0.80 | 0.80 |
| F | B | $H_2O_2$ | 0.80 | 0.80 | 0.80 |
| G | B | Persulfate | 0.79 | 1.20 | 1.40 |

The results in TABLE X show that the acidic stop solution containing a polyphosphonic acid is as effective at stopping development as an acetic acid stop solution. The data also show that the given phosphonic acid-containing stop solution and the persulfate bleaching solution produced incomplete bleaching in the processed photographic color papers.

EXAMPLE 2

Alternative Acidic Stop Solution and Method of Use

In this example, samples of EKTACOLOR® EDGE color paper were processed using the processing protocols and solutions used in Example 1 except that the acidic stop solution contained 2-dimethylaminoethanethiol-HCl ("DMAET") and diethylenetriaminopenta(methylenephosphonic acid) ("D2060S") instead of MMDP. Processing results are shown in the following TABLE XII.

TABLE XI

| Acidic Stop Solution C: | |
|---|---|
| Water | 900 ml |
| D2060S | 0.1 mol/l |
| 2-Dimethylaminoethanethiol-HCl | 0.02 mol/l |
| Water to make | 1.0 liter |
| pH 2.5 adjusted with KOH or $H_2SO_4$ | |

TABLE XII

| Method | Stop Solution | Bleaching Solution | $D_{min}$ | $D_{mid}$ | $D_{max}$ |
|---|---|---|---|---|---|
| | | | IR density @ 1000 nm | | |
| B | A | | 0.79 | 1.38 | 1.57 |
| C | A | RA | 0.80 | 0.80 | 0.80 |
| H | C | RA | 0.80 | 0.80 | 0.80 |
| I | C | $H_2O_2$ | 0.80 | 1.11 | 1.52 |
| J | C | Persulfate | 0.80 | 0.80 | 1.08 |

TABLE XII shows that the acidic stop solution of this invention containing a thiol and polyphosphonic acid was as effective at stopping development and facilitating subsequent bleaching of the color paper samples as a conventional acetic acidic stop bath if the EKTACOLOR® RA bleaching solution is used. However, the data also show that with the given peroxide and persulfate-bleaching solutions, bleaching was slower when the thiol-containing phosphonic acid stop solution was used. In the presence of the thiol, we observed that the persulfate solution bleached more completely in 45 seconds than the peroxide solution. Complete bleaching was achieved in 60 and 90 sec for the persulfate and peroxide bleaching solutions respectively.

EXAMPLE 3

Alternative Acidic Stop and Washing Solutions

Acidic stop and washing solutions of the present invention were prepared containing various surfactants as shown in the following TABLE XIII.

TABLE XIII

| Solution* | Polyphosphonic acid | Thiol | Surfactant | Biocide |
|---|---|---|---|---|
| D | MMDP (0.04 mol/l | L-Cysteine, (0.005 mol/l) | POLY-TERGENT ® SLF-18B-22, (0.25 g/l) | None |
| E | MMDP (0.04 mol/l) | L-Cysteine, (0.01 mol/l) | TRITON ® DF-20, (0.5 g/l | Kathon LX |
| F | MMDP (0.04 mol/l) | L-Cysteine, (0.01 mol/l) | 10G (0.5 g/l) | Kathon LX |
| G | MMDP (0.04 mol/l) | DMAET (0.01 mol/l) | TRITON ® DF-20 (0.5 g/l) | None |
| H | MMDP/D2060S 0.02 mol/l & 0.04 mol/l | DMAET (0.01 mol/l) | Rhodafec BP-769 (0.25 g/l) | None |
| I | MMDP/D2060S 0.02 mol/l & 0.04 mol/l | None | Rhodafec BP-769 (0.25 g/l) | Kathon LX |
| J | D2060S (0.1 mol/l) | DMAET (0.01 mol/l) | 10G (1 g/l) | None |
| K | D2060S (0.05 mol/l) | DMAET (0.005 mol/l) | 10G (0.5 g/l) | Kathon LX |
| L | D2060S (0.05 mol/l) | DMAET (0.005 mol/l) | TRITON ® DF-20, (0.5 g/L) & 10G (0.5 g/l) | Kathon LX |

*All baths were adjusted to pH 2.5 before processing.

POLY-TERGENT® SLF-18B-22 surfactant is available from Olin Corporation, TRITON® DF-20 surfactant is available from DOW Chemical Company, 10G surfactant is available from Olin Corporation, and Rhodafac BP-769 surfactant is available from Rhodia Inc.

In this example, a series of acidic stop solutions (TABLE XIII) was prepared for used in the processing of samples of EKTACOLOR® EDGE paper using the separate bleaching and fixing process described in TABLE IV above. The acidic solutions containing different anionic and nonionic or a combination of both were used first as development stop baths and later as washing solutions. After processing, all samples were air-dried and their IR densities revealed that complete bleaching was achieved after 45 seconds. Evaluation of the paper samples also showed no water spotting or crystal residue after washing with the acidic solutions.

The invention has been described in detail with particular reference to preferred embodiments thereof, but it will be understood that variations and modifications can be effected within the spirit and scope of the invention.

We claim:

1. A method for providing a color photographic image comprising:

A) color developing an imagewise exposed color photographic material using a color developing composition comprising at least 0.0005 mol/l of a color developing agent, B) stopping color development by contacting said color photographic material with an acidic stop solution having a pH less than or equal to 5, and C) desilvering said color photographic material with a composition having photographic bleaching capability, provided that said acidic stop solution comprises at least 0.001 mol/l of a polyphosphonic acid or a salt thereof, and a portion of said stop solution is carried over into said bleaching composition at a rate so that the amount of said polyphosphonic acid (or salt thereof) carried over into said bleaching composition is from about 0.000005 to about 0.001 mol per $m^2$ of processed color photographic material.

2. The method of claim 1 wherein said acidic stop solution further comprises a heterocyclic, aliphatic, or aromatic thiol.

3. The method of claim 1 wherein said polyphosphonic acid (or a salt thereof) is present in said acidic stop solution in an amount of from about 0.001 to about 1 mol/l.

4. The method of claim 1 wherein said acidic stop solution has a pH of from about 1 to about 4.8.

5. The method of claim 1 wherein said polyphosphonic acid (or a salt thereof) is a diphosphonic acid (or a salt thereof), polyaminopolyphosphonic acid (or a salt thereof), or cyclicaminodiphosphonic acid (or a salt thereof).

6. The method of claim 5 wherein said diphosphonic acid (or a salt thereof) is a hydroxyalkylidene diphosphonic acid (or a salt thereof), aminodiphosphonic acid (or a salt thereof), amino-N,N-dimethylenephosphonic acid (or a salt thereof), or N-acyl aminodiphosphonic acid (or a salt thereof).

7. The method of claim 5 wherein said polyaminopolyphosphonic acid (or a salt thereof) is a compound that is represented by the following Structure I:

(I)

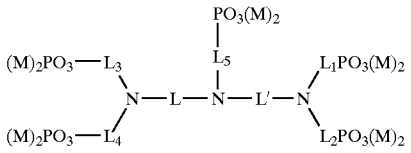

wherein L, L', $L_1$, $L_2$, $L_3$, $L_4$ and $L_5$ are independently substituted or unsubstituted divalent aliphatic linking groups, each independently having 1 to 4 carbon, oxygen, sulfur or nitrogen atoms in the linking group chain, and M is hydrogen or a monovalent cation.

8. The method of claim 5 wherein said polyphosphonic acid (or a salt thereof) is a compound that is represented by the following Structure II:

(II)

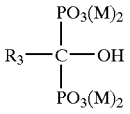

wherein $R_3$ is a substituted or unsubstituted alkyl group having 1 to 5 carbon atoms, and M is hydrogen or a monovalent cation.

9. The method of claim 5 wherein said polyphosphonic acid (or a salt thereof) is a cyclicaminodiphosphonic acid (or a salt thereof) wherein the cyclicamino group comprises a substituted or unsubstituted 3- to 6-membered ring that is attached to a methyl group that includes two phosphonic acids (or salts thereof).

10. The method of claim 9 wherein said cyclicaminomethanediphosphonic acid (or a salt thereof) is morpholinomethanediphosphonic acid (or a salt thereof).

11. The method of claim 1 wherein said color developing composition comprises a color developing agent that is present in an amount of at from about 0.0005 to about 0.25 mol/l, and an antioxidant that is a monoalkyl- or dialkylhydroxylamine derivative that is present in an amount of at least 0.0005 mol/l.

12. The method of claim 1 wherein said color photographic material is a color photographic paper or a color negative film.

13. The method of claim 1 that is carried out in a minilab.

14. The method of claim 1 wherein said bleaching composition is a bleach-fixing composition.

15. The method of claim 1 wherein said acidic stop solution is carried over into said bleaching composition at a rate of from about 0.000005 to about 0.001 ml per $m^2$ of processed photographic material.

16. A method for providing a color photographic image comprising:

A) color developing an imagewise exposed color negative photographic film or color photographic paper using a color developing composition comprising at least 0.0005 mol/l of a color developing agent and at least 0.0005 mol/l of an organic antioxidant, B) stopping color development by contacting said color photographic material with an acidic stop solution having a pH of from about 1 to about 5, and comprising from about 0.001 to about 1 mol/l of morpholinomethanediphosphonic acid (or a salt thereof) and from about 0.0005 to about 0.5 mol/l of L-cysteine or 2-dimethylaminoethanethiol-HCl, C) bleaching said color negative photographic film or color photographic paper with a peroxide or persulfate photographic bleaching composition, and D) subsequently or simultaneously, fixing said bleached color negative photographic film or color photographic paper, wherein said acidic stop solution is carried over into said bleaching composition at a rate such that said morpholinomethanediphosphonic acid (or a salt thereof) is carried over to said bleaching composition in an amount of from about 0.000005 to about 0.001 mol per $m^2$ of processed color negative photographic film or color photographic paper.

* * * * *